US005284265A

United States Patent [19]

Crisci

[11] Patent Number: 5,284,265

[45] Date of Patent: Feb. 8, 1994

[54] NON-REPLACEABLE SNAP ON CAP FOR SCHOOL MILK BOTTLES

[75] Inventor: Harry E. Crisci, New Castle, Pa.

[73] Assignee: Northern Engineering & Plastics Corp., New Castle, Pa.

[21] Appl. No.: 24,343

[22] Filed: Mar. 1, 1993

Related U.S. Application Data

[63] Continuation-in-part of Ser. No. 931,006, Aug. 17, 1992, Pat. No. 5,224,616.

[51] Int. Cl.[5] ..... B65D 41/46

[52] U.S. Cl. ..... 215/256; 215/254; 215/258; 215/320; 220/270; 220/276

[58] Field of Search ..... 215/256, 305, 258, 254, 215/320; 220/270, 276

[56] References Cited

U.S. PATENT DOCUMENTS

| | | | |
|---|---|---|---|
| 3,834,571 | 9/1974 | Bartell | 215/256 |
| 4,522,308 | 6/1985 | Sullivan | 215/256 X |
| 4,836,407 | 6/1989 | Bruce et al. | 220/276 |
| 4,966,292 | 10/1990 | Marino | 215/256 |
| 5,038,951 | 8/1991 | Rizzardi | 215/256 |
| 5,129,531 | 7/1992 | Beck et al. | 215/256 |

FOREIGN PATENT DOCUMENTS

| | | | |
|---|---|---|---|
| 0662433 | 5/1979 | U.S.S.R. | 215/256 |

*Primary Examiner*—Allan N. Shoap
*Assistant Examiner*—Vanessa Caretto
*Attorney, Agent, or Firm*—Harpman & Harpman

[57] ABSTRACT

A snap on non-replaceable cap for a plastic school milk bottle neck finish with an external annular rib has a top with an inwardly spaced sealing flange depending therefrom, the outer surface of the sealing flange is shaped downwardly and inwardly. A tear skirt having an inturned annular flange forming the peripheral edge of the top is joined to the top by a thin semi-annular tear line. An inturned rib is formed on the inner surface of the tear skirt which locks under the external rib on the neck finish. The tear skirt, including the inturned annular flange may be completely or partially torn away from the top to permit the top to be removed. To facilitate removal, the tear skirt is formed with a second tear line from a lower edge thereof to the thin semi-annular tear line in the top. A pull tab is formed adjacent the second tear line functions as a lift tab to remove the cap. The top and its depending sealing flange prevent the same from being replaced on the bottle.

4 Claims, 1 Drawing Sheet

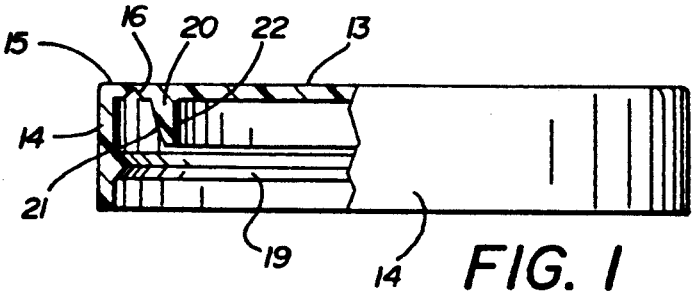
FIG. 1
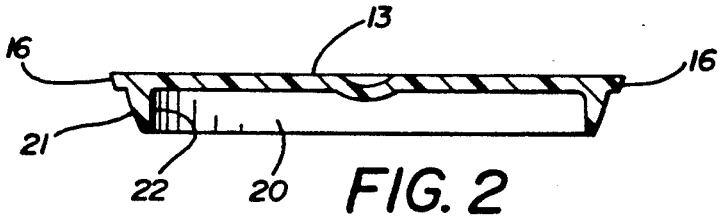
FIG. 2
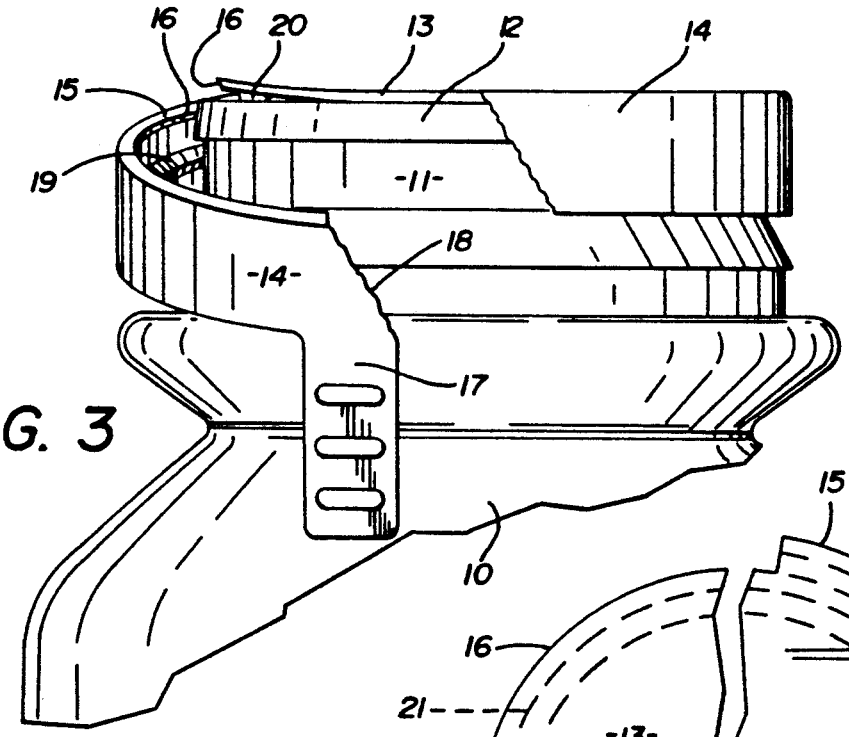
FIG. 3
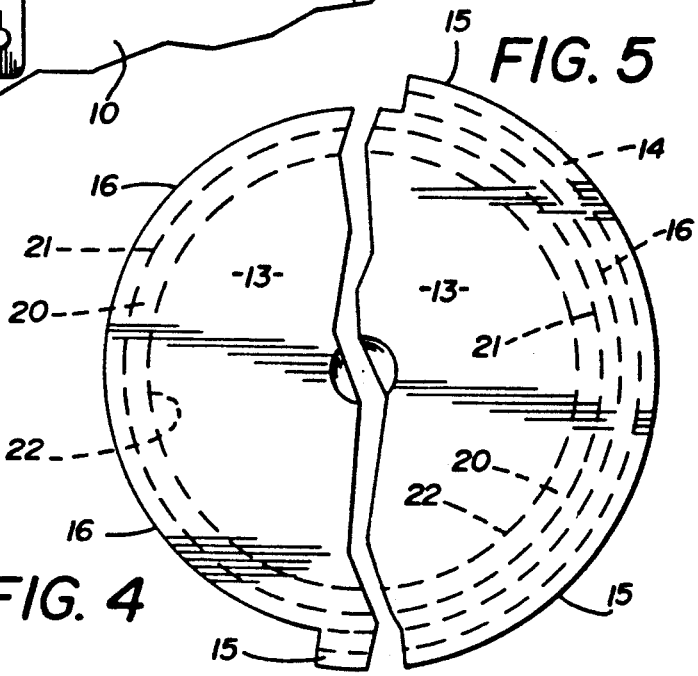
FIG. 5
FIG. 4

NON-REPLACEABLE SNAP ON CAP FOR SCHOOL MILK BOTTLES

This is a continuation-in-part of application Ser. No. 07/931,006, filed Aug. 17, 1992, now U.S. Pat. No. 5,224,616, issued Jul. 6, 1993.

TECHNICAL FIELD

This invention relates to a new and improved snap on type plastic cap which fits on the neck finish of a plastic bottle such as an eight ounce school milk bottle which has an external annular rib. The cap is characterized in that when the tear skirt of the cap is torn off to permit removal of the cap, the remaining top of the cap cannot be reattached to the bottle neck due to the shape of the angular outer surface of a sealing flange depending from the top portion so as to prevent the use of the cap as a reclosure cap.

DESCRIPTION OF THE PRIOR ART

Caps generally similar to that of the present invention are the subject of many patents including the following, all of which have means permitting the use of the cap or a portion thereof as a reclosure cap. The neck shown in the accompanying drawings resemble a commercially available neck of the type shown in U.S. Pat. No. 4,784,296 which also shows single diameter cap skirts which are frangile on a circumferential tear line.

Other single diameter cap skirts which are frangible on a tear line are shown in U.S. Pat. Nos. 4,593,830, 4,691,834, and 4,815,617.

Dual diameter cap skirts which are frangible on a circumferential line between two diameters are shown in U.S. Pat. Nos. 4,232,229, 4,844,268, 4,911,316, and 4,934,546. In each of the above prior art patents, means is provided in the upper skirt for a complimentary fastening relation to an external rib on the neck of the bottle and such means is positioned below the top of the cap and above the circumferential tear line.

SUMMARY OF THE INVENTION

The present invention comprises a cap which fits on the neck of a blow molded plastic bottle and is held thereon by an annular inturned rib on the inner surface of the tear skirt below a arcuate tear line which is defined by a semi-annular area of weakness in the top of the cap inwardly of the peripheral edge thereof and the top of the tear skirt. There is a second tear line which extends upwardly from the lower edge of the tear skirt adjacent a pull tab thereon to the semi-annular tear line in the top of the cap and is used to remove the tear skirt along the arcuate tear line in the top of the cap tear skirt. The uppermost inturned edge of the tear skirt forms an annular peripheral edge of the top of the cap. The inturned annular rib on the tear skirt is engaged beneath the external annular rib on the neck finish.

The annular sealing flange on the cap inwardly of the semi-annular tear line in the top is provided with a downturned outermost resilient surface that resists replacement in the neck of the bottle when the tear skirt is completely or partially removed as the top portion and annular sealing flange of the snap on cap will not stay engaged on the upper end of the neck portion of a bottle when the tear skirt of the cap is removed.

DESCRIPTION OF THE DRAWINGS

FIG. 1 is a vertical sectional view through a cap in accordance with the present invention;

FIG. 2 is a vertical sectional view through the upper portion of the cap with the tear skirt removed;

FIG. 3 is a side elevation of the cap with the tear skirt thereof partially removed from the upper portion positioned on a bottle; and FIG. 4 is a top plan view with parts broken away of FIG. 2 showing the arcuate tear line after the tear skirt has been removed; and FIG. 5 is a top plan view with parts broken away of FIG. 1 showing the top of the cap with the tear skirt and arcuate tear line therein.

DESCRIPTION OF THE PREFERRED EMBODIMENT

In FIG. 3 of the drawings, a bottle 10 has a neck portion 11 with an outturned rib 12 defining its upper end. A cap is positioned on the neck portion 11 and comprises a top 13 having a tear skirt 14 with an inturned annular flange 15 forming an upper edge thereof secured integrally to the top 13 by a semi-annular thin wall forming a tear line 16. A tab 17 is integrally formed with the tear skirt 14 of the cap and an upwardly extending thin wall forms a secondary tear line 18 between the lower edge of the tear skirt 14 and the arcuate tear line 16 and is located adjacent the tab 17.

Referring now to FIG. 1 of the drawings, it will be seen that the tear skirt 14 which is completely or partially removable from the neck finish of the neck 11 of the bottle 10 as hereinbefore referred to, is provided with an annular inturned rib 19 approximately midway between the inturned annular flange 15 which forms the upper end of the tear skirt 14 and the bottom of the tear skirt 14 and as illustrated in FIG. 1 it is preferably positioned slightly below an annular sealing flange 20 which depends from the top 13 of the non-replaceable cap inwardly of the semi-annular tear line 16, the thin wall thereof forming the attachment of the tear skirt 14 with the top 13 of the non-replaceable cap. The annular sealing flange 20 is formed with its outermost surface 21 shaped downwardly and inwardly preferably in a slightly curving surface which results in a resilient characteristic essential to the function of the invention as its opposite inner surface 22 is substantially straight which results in the cross sectional shape of the annular sealing flange 20 tapering from a thick base where it joins the top 13 to a much thinner lower end portion.

By referring now to FIG. 2 of the drawings, the top 13 of the non-replaceable cap may be seen in cross section after all of the tear skirt 14 has been removed therefrom as occurs when the tear tab 17 is moved upwardly and outwardly and the tear skirt 14 is completely separated at the semi-annular thin wall tear line 16 which in its as-formed and used shape joins the inturned flange 15 of the tear skirt 14 with the top 13.

In FIG. 2 of the drawings, the straight inner surface of the sealing flange 20 and the downwardly angular or curved surface 21 illustrates the cross sectional shape and it will be observed that in effect this is all that remains of the non-replaceable cap which is incapable of being replaced on the neck 11 of the bottle 10 as the outer diameter of the annular sealing flange 20 is slightly greater than the outer diameter of the outturned annular rib 12 on the neck 11 of the bottle.

Again referring to FIG. 3 of the drawings, it will be seen that the skirt 14 has been partially removed from the top 13 by the separation of the arcuate tear line 16 leaving the skirt 14 with the inturned flange 15 on its uppermost edge. It will be observed that the top 13 by reason of the annular sealing flange 20 and its configuration and resiliency makes it practically impossible to place the top 13 with the annular sealing flange 20 thereon in the opening in the neck portion 11 of the bottle 10 and thus achieves the principal object of the invention in making the cap non-replaceable with respect to the neck portion 11 of the bottle 10 as any effort to replace the top 13 with or without the partially or completely detached skirt 14 is successfully resisted by the resilient characteristics of the annular sealing flange 20.

By referring now to FIG. 4 of the drawings, a partial top plan view of FIG. 2 of the drawings may be seen and wherein the top 13 is shown with the tear line 16 after the tear skirt 14 has been completely removed. Broken lines indicate the inner and outer surfaces of the annular sealing flange 20.

FIG. 5 of the drawings is a top plan view with parts broken away showing the top of the cap with the thin wall arcuate tear line 16 therein and the tear skirt 14 attached thereto by way of the inturned flange 15 which defines the upper edge of the tear skirt 14.

It will thus be seen that when only the top 13 of the non-replaceable cap as illustrated in FIG. 2 of the drawings is pushed downwardly onto the upper end of the neck portion 11 of the bottle 10, its elasticity and resulting distortion due to its resilience will cause it to resist engaging the opening defined by the neck of the bottle so that it is therefore not capable of being used as a reclosure cap.

The present use of the invention makes this feature highly desirable as the cap is used as a non-replaceable cap or removable flexible cap for school milk bottles which as known provide a small quantity of milk, usually eight ounces, such as chocolate milk, orange juice, tomato juice, and the like. The non-replaceable cap prevents a school child from attempting to save part of the beverage by replacing the cap, as the cap simply cannot be replaced on the neck of the bottle as hereinbefore explained.

It will thus be seen that a non-replaceable snap on cap for plastic school milk bottles and the like has been disclosed which incorporates a novel construction serving the dual purpose of assisting and retaining the cap in position on the neck of a bottle of known configuration by reason of the tear skirt being provided with the inturned annular rib 19 which will engage beneath the extending rib 12 in a locking manner so as to retain the cap on the school milk bottle until such time as the tear skirt is removed as hereinbefore described.

It will further be seen that when the tear skirt 14 has been partially or completely removed, the remaining disc-like top 13 with its depending annular sealing flange 20 remains and that any effort to replace this in the neck 11 of the bottle 10 is resisted strongly by the resilient inwardly and downwardly tapering annular sealing flange 20 as hereinbefore described.

Having thus described my invention, what I claim is:

1. A snap on non-replaceable resilient cap comprises a top, an annular tear skirt depending from said top an inturned flange forming an upper edge of said tear skirt and an annular sealing flange depending from said top inwardly of said annular tear skirt, said sealing flange having an outer surface curved downwardly from said top, an annular inturned rib on the inner surface of said tear skirt in spaced vertical relation to said inturned flange, said inturned flange on said tear skirt joined to said top by a continuous tear line, a second tear line in said tear skirt extending outwardly and downwardly from the arcuate tear line and a tab formed on said tear skirt adjacent the second tear line to facilitate removal of the tear skirt.

2. The snap on non-replaceable resilient cap of claim 1 wherein said curved surface of said sealing flange curves downwardly and inwardly from said top.

3. The snap on non-replaceable resilient deformable cap of claim 1 wherein the sealing flange is progressively thinner downwardly from said top.

4. A snap on non-replaceable cap formed of a resilient plastic for use on a container, said container having a neck, a rib on said neck at its exterior upper end, said cap comprising a top, a tear skirt having an inturned flange defining its upper edge, a retaining means on said tear skirt being located below said rib for engagement therewith, said tear skirt depending from said top and having a bottom edge, an annular depending sealing flange on said top spaced inwardly of said tear skirt and inturned flange, said annularly depending sealing flange having a downturned and inturned progressively thinner outer surface, said inturned flange on said tear skirt joined to said top so as to form a first continuous tear line, a second tear line in said tear skirt extending from said first tear line and to said bottom edge and a tab formed adjacent the second tear line to facilitate removal of the tear skirt leaving the top and the annular sealing flange that resist attempts to replace the same on said container neck.

* * * * *